US009476642B2

(12) United States Patent
Kim et al.

(10) Patent No.: US 9,476,642 B2
(45) Date of Patent: Oct. 25, 2016

(54) METHOD FOR REMOVING LIQUID MEMBRANE USING HIGH-SPEED PARTICLE BEAM

(71) Applicant: POSTECH ACADEMY-INDUSTRY FOUNDATION, Pohang-si, Gyeongsangbuk-do (KR)

(72) Inventors: In Ho Kim, Busan (KR); Jin Won Lee, Pohang-si (KR)

(73) Assignee: POSTECH ACADEMY-INDUSTRY FOUNDATION, Pohang-si, Gyeongsangbuk-do (KR)

( * ) Notice: Subject to any disclaimer, the term of this patent is extended or adjusted under 35 U.S.C. 154(b) by 20 days.

(21) Appl. No.: 14/652,045

(22) PCT Filed: Oct. 25, 2013

(86) PCT No.: PCT/KR2013/009555
§ 371 (c)(1),
(2) Date: Jun. 12, 2015

(87) PCT Pub. No.: WO2014/098365
PCT Pub. Date: Jun. 26, 2014

(65) Prior Publication Data

US 2015/0323252 A1 Nov. 12, 2015

(30) Foreign Application Priority Data

Dec. 18, 2012 (KR) ..... 10-2012-0148974

(51) Int. Cl.
*F26B 21/06* (2006.01)
*F26B 5/00* (2006.01)
(Continued)

(52) U.S. Cl.
CPC . *F26B 5/00* (2013.01); *B08B 3/04* (2013.01); *B24C 1/003* (2013.01); *F26B 3/34* (2013.01); *F26B 3/36* (2013.01); *F26B 5/04* (2013.01); *F26B 19/00* (2013.01)

(58) Field of Classification Search
CPC ..... F26B 5/00; F26B 19/00; F26B 21/00; F26B 21/06; B29C 41/00; B29C 41/28; B29L 7/00; B08B 3/00; B08B 3/04
USPC ..... 34/78, 79, 381, 413, 497; 424/489, 718; 128/203.15; 134/7, 902
See application file for complete search history.

(56) References Cited

U.S. PATENT DOCUMENTS 5,727,333 A * 3/1998 Folan ..... F26B 5/065 34/285
6,544,357 B1 * 4/2003 Hehmann ..... C23C 14/14 148/420

(Continued)

FOREIGN PATENT DOCUMENTS

CH EP 2444545 A1 * 4/2012 ..... B01J 13/14
GB 1445008 A * 8/1976 ..... H01L 21/67051

(Continued)

OTHER PUBLICATIONS

Search Report for International Application No. PCT/KR2013/009555.

*Primary Examiner* — Stephen M Gravini
(74) *Attorney, Agent, or Firm* — LRK Patent Law Firm

(57) ABSTRACT

A method for removing a liquid membrane using a high-speed particle beam includes a wet washing step of washing an object by using a washing solution, and a dry washing step of simultaneously removing the washing solution remaining on the object and pollutants or foreign substances in the washing solution by spraying sublimation particles.

18 Claims, 3 Drawing Sheets

(51) Int. Cl.

| | |
|---|---|
| ***B08B 3/04*** | (2006.01) |
| ***F26B 19/00*** | (2006.01) |
| ***F26B 3/36*** | (2006.01) |
| ***F26B 5/04*** | (2006.01) |
| ***B24C 1/00*** | (2006.01) |
| ***F26B 3/34*** | (2006.01) |

(56) References Cited

U.S. PATENT DOCUMENTS 7,007,406 B2 * 3/2006 Wang ..... F26B 13/30 34/286
7,202,246 B2 * 4/2007 Ma ..... C07D 491/22 514/250
7,363,729 B2 * 4/2008 Tanaka ..... F26B 3/28 205/333
8,061,056 B2 * 11/2011 Hedberg ..... B01D 1/14 118/320
8,322,046 B2 * 12/2012 Wang ..... A61K 9/1623 134/172
8,912,128 B2 * 12/2014 Cha ..... G01N 33/56911 435/34
9,052,138 B2 * 6/2015 DeMarco ..... F26B 5/065 34/287
9,221,027 B2 * 12/2015 Kuppler ..... B01J 10/005
2010/0074934 A1 * 3/2010 Hunter ..... A61F 2/16 424/422
2015/0321314 A1 * 11/2015 Lee ..... B24C 5/04 239/1
2015/0323252 A1 * 11/2015 Kim ..... F26B 3/36 34/391
2015/0325429 A1 * 11/2015 Kim ..... G03F 7/42 134/7

FOREIGN PATENT DOCUMENTS

JP 2001267536 A * 9/2001
JP 2006-199029 A 8/2006
JP 2009-066983 A 4/2009
JP 2009-078444 A 4/2009
KR 10-0359339 B1 11/2002
KR 20030075992 A * 9/2003 ..... B82Y 30/00
KR 101272785 B1 * 6/2013 ..... F26B 3/36
RU WO 2005035113 A1 * 4/2005 ..... A61M 1/3679

* cited by examiner

METHOD FOR REMOVING LIQUID MEMBRANE USING HIGH-SPEED PARTICLE BEAM

TECHNICAL FIELD

The present invention relates to a method of removing a liquid membrane using a high-speed particle beam, and more specifically, to a method of removing various pollutants contained in a liquid, as well as the liquid forming a liquid membrane, by radiating a high-speed particle beam onto the liquid membrane remaining on the surface of a washing object after performing wet washing.

BACKGROUND ART

In a general wet washing process, a process of washing the surface of a washing object using a washing solution is performed to remove foreign substances or pollutants attached on the surface of the washing object. In this process, it is general that the washing solution is injected at a high speed or churned using ultrasonic waves or the like to enhance efficiency of washing.

Meanwhile, after the washing process is finished, some of the washing solution and the foreign substances or pollutants always remain on the surface of the washing object.

It is apparent that some of the foreign substances or pollutants remain in the washing solution after the washing is finished as described above, and, in addition, molecules or ions of an additive added to the washing solution to improve cleaning power remain together with the washing solution. Therefore, it is general to perform an additional drying process to remove the washing solution remaining as described above.

Although liquid materials (solvents) forming the washing solution is quickly removed in the drying process through evaporation, a large amount of melt or floating materials is not removed and still remains on the surface, and thus a separate removing process is additionally required.

In addition, there is a problem in that a secondary defect occurs due to the remaining materials.

DISCLOSURE OF INVENTION

Technical Problem

Therefore, the present invention has been made in view of the above problems, and it is an object of the present invention to provide a method of removing a liquid membrane using a high-speed particle beam, which can simultaneously remove a washing solution remaining on an object and pollutants or foreign substances contained in the washing solution after performing a wet washing process.

Technical Solution

To accomplish the above object, according to one aspect of the present invention, there is provided a method of removing a liquid membrane using a high-speed particle beam, the method including: a wet washing step of washing an object using a washing solution, and a dry washing step of simultaneously removing the washing solution remaining on the object and pollutants or foreign substances contained in the washing solution by injecting sublimation particles.

Advantageous Effects

Since the method of removing a liquid membrane using a high-speed particle beam according to the present invention may simultaneously remove the liquid membrane formed on an object and pollutants or foreign substances contained therein in one process, the problem of remaining the pollutants or foreign substances on the object can be solved in comparison with a conventional method of simply drying the liquid membrane, and thus it is effective in that an additional process is not required to solve the problem, and a secondary defect caused by the remaining materials can be prevented in advance.

In addition, since an additional wet washing process for removing the remaining materials is not required, it has an effect of preventing environmental pollution by reducing chemical wastewater.

In addition, since additional washing processes can be reduced remarkably, productivity, economic efficiency and spatial efficiency can be improved simultaneously.

DESCRIPTION OF SYMBOLS

Figure 1:
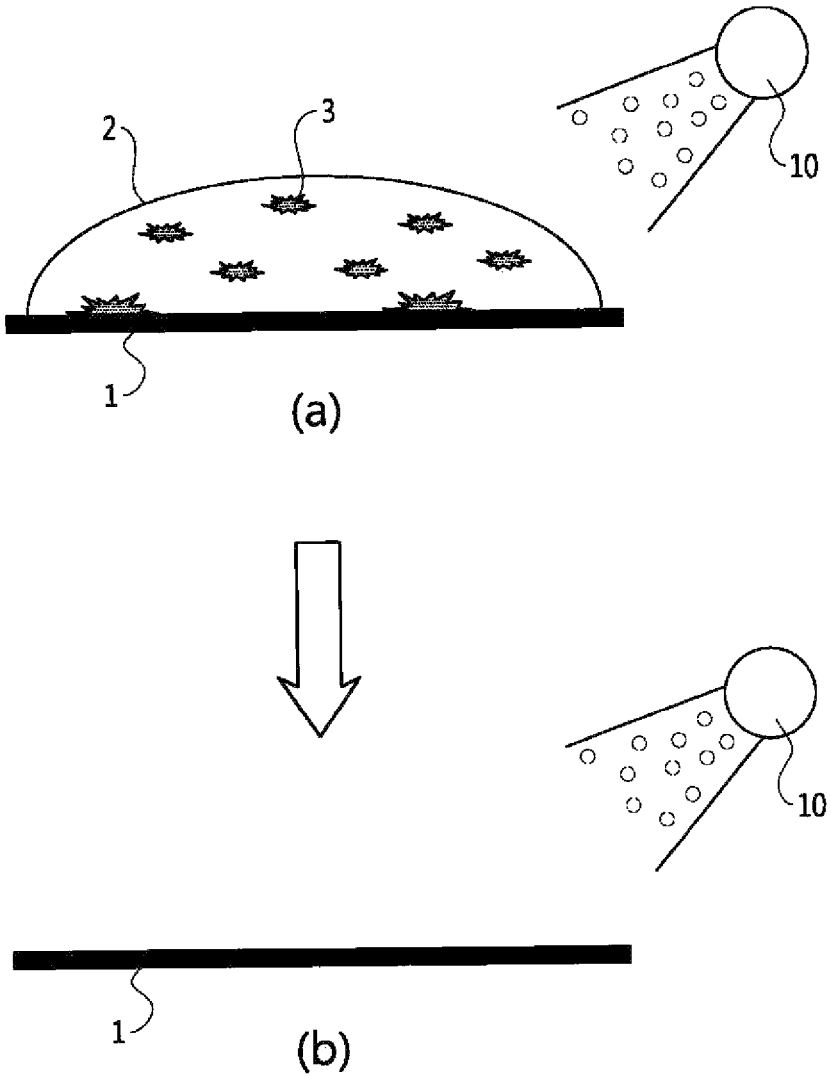
FIG. 1 is a view schematically showing the main concept of a method of removing a liquid membrane using a high-speed particle beam according to an embodiment of the present invention.

1: Object
2: Liquid membrane, Washing solution
3: Pollutant or Foreign substance
10: Nozzle
11: Nozzle throat
12: Orifice
13: Orifice block
14: First dilating portion
15: Second dilating portion
16: Third dilating portion
17: Gas supply tube
18: Heat insulation unit
19: Nozzle axis
20: Pressure controller
30: Mixing chamber
40: Particle generation gas storage unit
50: Carrier gas storage unit
$\theta_1$, $\theta_2$, $\theta_3$: Dilation angle

BEST MODE FOR CARRYING OUT THE INVENTION

Hereafter, specific contents for embodying the present invention will be described in detail with reference to the accompanying drawings.

FIG. 1 is a view schematically showing the main concept of a method of removing a liquid membrane using a high-speed particle beam according to an embodiment of the present invention. FIG. 1(*a*) shows a liquid membrane formed on an object and pollutants or foreign substances contained therein, and FIG. 1(*b*) shows an object of a washed state.

As shown in FIG. 1, a method of removing a liquid membrane using a high-speed particle beam according to the present invention corresponds to a method of removing a liquid membrane 2 formed on the surface of an object 1 and pollutants or foreign substances 3 contained in the liquid membrane 2 by injecting sublimation particles.

First, the method of removing a liquid membrane using a high-speed particle beam according to an embodiment of the present invention relates to removing washing solution remaining on the object 1 and the pollutants or foreign substances 3 contained in the washing solution after performing a wet washing step. The liquid membrane 2 shown in FIG. 1 can be regarded as washing solution remaining after the wet washing step is performed. Hereinafter, a reference numeral '2', which is the same as that of the liquid membrane, will be used for the washing solution.

Figure 2:
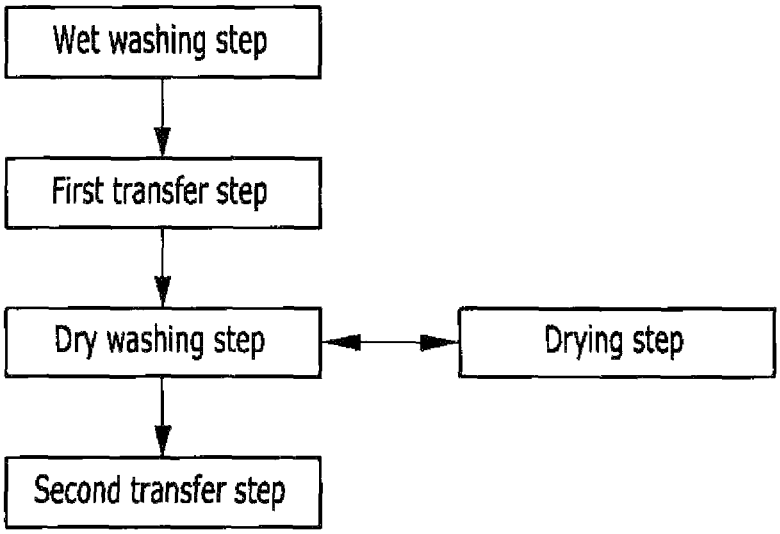
FIGS. 2 and 3 are flowcharts illustrating a method of removing a liquid membrane using a high-speed particle beam according to an embodiment of the present invention, which includes a wet washing step.
Figure 3:
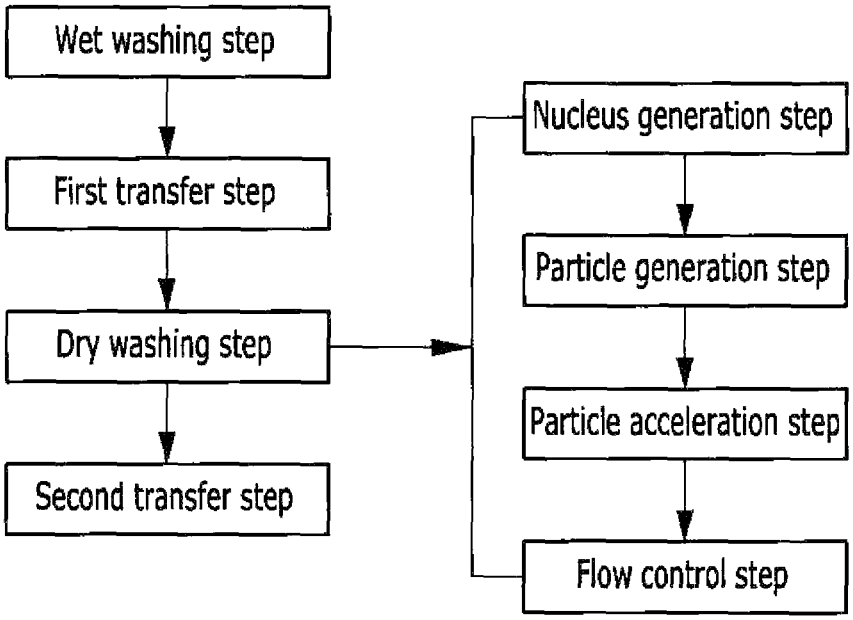

FIGS. 2 and 3 are flowcharts illustrating a method of removing a liquid membrane using a high-speed particle beam, which includes the wet washing step.

As shown in FIGS. 2 and 3, the method of removing a liquid membrane using a high-speed particle beam according to an embodiment of the present invention is configured to include a wet washing step, a first transfer step, a dry washing step and a second transfer step.

First, the wet washing step is a process of washing an object 1 using a washing solution 2. The washing solution 2 is inevitably remained on the surface of the object 1 passing through the wet washing step, and pollutants or foreign substances 3 are contained in the remaining washing solution 2. For example, various organic materials, metallic impurities, alkaline ions, hydroxide materials may be the pollutants or foreign substances 3.

The dry washing step is a process of simultaneously removing the washing solution 2 and the pollutants or foreign substances 3 contained therein by injecting sublimation particles. Although it is general in the prior art that the washing solution 2 is evaporated by simply adding a drying process after wet washing, in this case, there is a problem in that materials having a property not being evaporated, among the pollutants or foreign substances 3 contained in the washing solution 2, still remain on the surface of the object 1. In addition, the washing solution 2 has a problem of remaining stains because of various additives. The dry washing step removes the washing solution 2 together with the pollutants or foreign substances 3 by injecting sublimation particles to solve such a problem.

On the other hand, it is preferable that the dry washing step is progressed together with a drying step as shown in FIG. 2. Although the drying step of the prior art is a process for simply evaporating the washing solution 2, the drying step of the present invention is a process of preventing condensation of moisture on the surface of the object 1 which occurs due to a cooling effect caused by the sublimation particles and immediately evaporating moisture although there is some condensed moisture. It may be considered to include a heating step of heating the object 1 in such a drying step by providing a heating device such as a hot plate or the like under the object 1. On the other hand, the drying step may include a nitrogen injection step of drying the surface of the object by injecting nitrogen on the object 1. Although the heating step and the nitrogen injection step may be separately performed, it is further preferable to simultaneously perform the steps.

In addition, as shown in FIG. 3, the dry washing step is preferably configured of detailed steps including a nucleus generation step, a particle generation step, a particle acceleration step and a flow control step.

The dry washing step includes a series of processes for generating sublimation particles by passing a particle generation gas through a nozzle 10 and accelerating and injecting the sublimation particles on the object 1.

Figure 4:
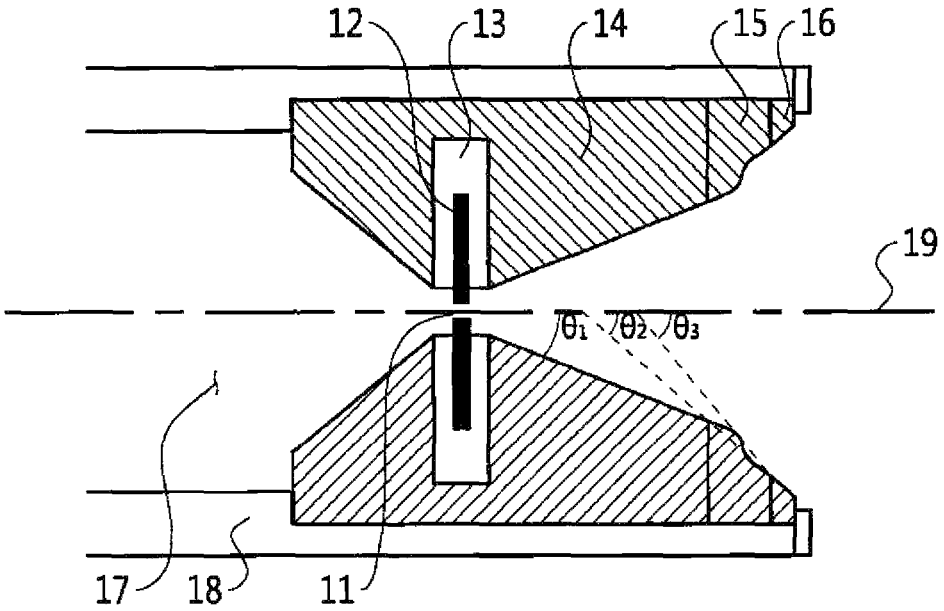
FIG. 4 is a cross-sectional view showing a nozzle used in a dry washing step according to an embodiment of the present invention.
Figure 5:
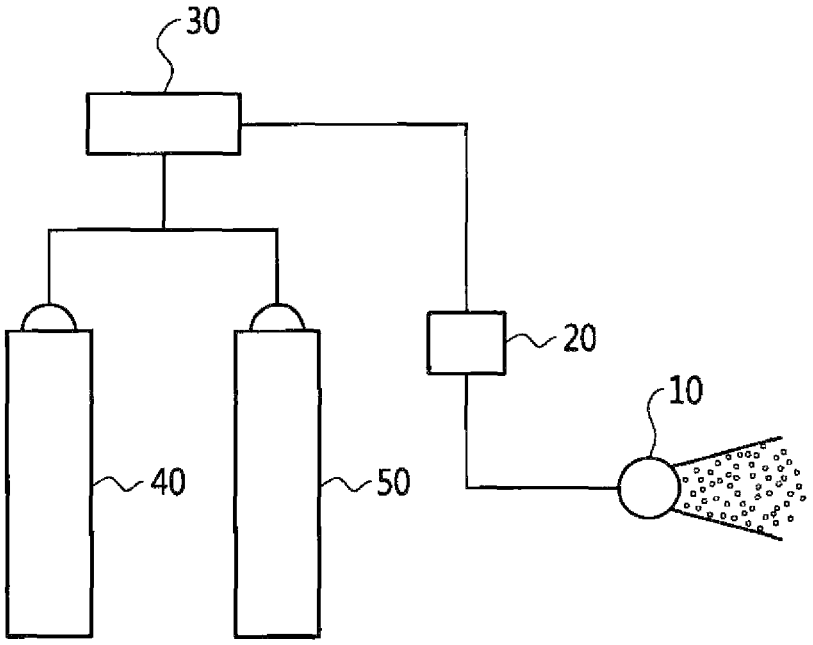
FIG. 5 is a view showing major parts configuring a dry washing device used in a dry washing step according to an embodiment of the present invention.

FIG. 4 is a cross-sectional view showing a nozzle used in the dry washing step, and FIG. 5 is a view showing major parts configuring a dry washing device including a nozzle. Hereinafter, each of the detailed steps will be described in detail with reference to the figures.

First, the nucleus generation step of generating nuclei is performed as a particle generation gas rapidly expands while passing through an orifice 12 provided in a nozzle throat 11 of the nozzle 10. Generation of nuclei can be induced at a room temperature without a separate cooling device by providing an orifice 12 having a microscopic hole to rapidly expand the particle generation gas, and it may be also possible to generate nuclei of a uniform size as the particle generation gas rapidly expands.

Then, after performing the nucleus generation step, the particle generation step of generating sublimation particles is performed as growth of nuclei is accomplished while the particle generation gas passes through a first dilating portion 14 extended from the outlet of the nozzle throat 11 and having a dilation angle $\theta_1$ of 0° to 30°. The first dilating portion 14 is formed to have a comparatively gentle dilation angle $\theta_1$ compared with a second dilating portion 15 and provides a sufficient time for the nuclei to grow.

Then, after performing the particle generation step, the particle acceleration step of offsetting growth of a boundary layer and increasing the speed of injecting the sublimation particles is performed as the particle generation gas passes through the second dilating portion 15 extended from the outlet of the first dilating portion 14 and having an average dilation angle $\theta_2$ increased by 10° to 45° compared with the dilation angle $\theta_1$ of the first dilating portion 14. Although the first dilating portion 14 is formed to be comparatively long at a comparatively gentle dilation angle $\theta_1$ and induces growth of nuclei, it invites reduction of flowing speed since an effective area is reduced as the boundary layer is increased. Accordingly, the second dilating portion 15 capable of obtaining an additional accelerating force is provided to compensate the reduction of speed.

Meanwhile, since the second dilating portion 15 does not have a single dilation angle unlike the first dilating portion 14 and a third dilating portion, the angle is referred to as an average angle. If the dilation angle at the connection portion of the second dilating portion 15 is changed significantly in steps when the second dilating portion 15 is extended from the first dilating portion 14, an internal shock wave will be generated. Accordingly, the second dilating portion 15 is preferably formed in a shape having curves. Further specifically, the connection portion for connecting the second dilating portion 15 to the first dilating portion 14 is formed to have a dilation angle the same as the dilation angle $\theta_1$ of the outlet side of the first dilating portion 14, and the connection portion is formed to gradually increase the dilation angle toward the center of the second dilating portion 15 to form an acute inclination angle near the center and decrease the dilation angle from the center toward the outlet side of the second dilating portion 15 so that generation of the internal shock wave may be prevented.

It is preferable to further include, after performing the particle acceleration step, the flow control step of forming a high-speed core of the sublimation particles outside the nozzle 10 as the particle generation gas passes through the third dilating portion 16 extended from the outlet of the second dilating portion 15 and having a dilation angle $\theta_3$ increased by 10° to 45° compared with the average dilation angle $\theta_2$ of the second dilating portion 15 and lower than 90° in maximum. If back pressure at the rear end of the nozzle 10 is low, a flow field may additionally grow since a separation point goes farther from the nozzle throat 11, and thus it is preferable to form the third dilating portion 16 to induce the separation point to be positioned at the end portion of the dilating portion while securing a sufficient length at the same time. It is since that washing efficiency can be increased greatly by forming the high-speed core (isentropic core) outside the nozzle 10.

On the other hand, if the back pressure at the rear end of the nozzle 10 is formed to be high, it may be regarded that the flow field has already grown sufficiently since the separation point comes closer to the nozzle throat 11, and thus it is preferable to expose the high-speed core at the outside of the nozzle 10 by reducing the length of the third dilating portion 16.

On the other hand, the dry washing step may be divided into i) a case of using a mixture of a particle generation gas and a carrier gas and ii) a case of using only a particle generation gas.

Here, carbon dioxide or argon may be considered as the particle generation gas, and helium or nitrogen may be considered as the carrier gas.

In the case of using a mixture of a particle generation gas and a carrier gas, a particle generation gas storage unit 40 and a carrier gas storage unit 50 are connected to a mixing chamber 30. The mixing chamber 30 performs a function of sufficiently mixing the particle generation gas and the carrier gas and, at the same time, adjusting a mixing ratio. It is preferable that the mixing ratio is adjusted to form a carbon dioxide mixture gas by mixing the carrier gas with the particle generation gas so that mixing the carrier gas may occupy 10 to 99% of the total volume of the mixture.

The mixture gas mixed in the mixing chamber 30 flows into a pressure controller 20. The pressure controller 20 controls pressure for supplying the mixture gas to the nozzle 10.

On the other hand, in the case of using only a particle generation gas, it may be considered to supply the particle generation gas to the pressure controller 20 by directly connecting the particle generation gas storage unit 40 to the pressure controller 20 without passing through the mixing chamber 30. Hereinafter, a particle generation gas of the case using only a particle generation gas will be referred to as a pure particle generation gas as a concept contrasting to the mixture gas.

In addition, it is preferable that output pressure at the pressure controller 20 is formed within a range of i) 5 to 120 bar in the case of the mixture gas and ii) 5 to 60 bar in the case of the pure particle generation gas, considering the size and injection speed of the generated sublimation particles.

The mixture gas or the pure particle generation gas passing through the pressure controller 20 is supplied to the inlet of the nozzle 10.

The mixture gas or the pure particle generation gas supplied to the inlet of the nozzle 10 sequentially passes through the orifice 12, the first dilating portion 14 and the second dilating portion 15 as described above, and sublimation nano-particles are injected onto the object 1.

On the other hand, in the case of supplying only the pure particle generation gas, a pressure control step of adjusting the pressure of the particle generation gas is performed without performing the mixing step.

Here, it is preferable that pressure of the particle generation gas passing through the pressure control step is controlled to 5 to 60 bar to flow the particle generation gas into the nozzle 10.

The steps following thereafter are the same as the nucleus generation step, the particle generation step, the particle acceleration step and the flow control step.

On the other hand, it may be considered to perform the dry washing step inside a tightly sealed chamber, and the chamber is preferably filled with carbon dioxide or nitrogen so that condensation of moisture may not occur on the surface of the object 1 as the surface of the object 1 is cooled down by the sublimation particles. On the other hand, it may be considered to prevent condensation of moisture by separately injecting carbon dioxide or nitrogen directly onto the object 1 although the dry washing step is not performed inside the tightly sealed chamber.

In addition, it is preferable to further include a first transfer step of loading the object 1 onto a dry washing position as a prior step of the dry washing step, and it will be preferable to further include a second transfer step of unloading the object 1 from the dry washing position after performing the dry washing step so that the dry washing work may be performed as a comprehensive process.

An embodiment of removing a liquid membrane generated in a wet washing step is described above. The method of removing a liquid membrane using a high-speed particle beam according to the present invention may be applied to various processes in which liquid, including the washing solution 2, remains on the surface of an object 1 after the wet washing step is performed.

For example, the method of the present invention may be applied to a variety of fields requiring removal of a liquid membrane 2 formed on an object 1 and pollutants or foreign substances 3 contained therein, such as washing lubricant remaining on a sample after processing the sample in a milling process using the lubricant, washing various display panels, washing a solar power generation panel, washing an optical lens and the like. In this case, the wet washing step may be replaced with all the processes in which a liquid membrane 2 is formed on an object 1.

The positional relations used to describe a preferred embodiment of the present invention are described focusing on the accompanying drawings, and the positional relations may be changed according to the aspect of an embodiment.

In addition, unless otherwise defined, all terms used in the present invention, including technical or scientific terms, have the same meanings as those generally understood by those with ordinary knowledge in the field of art to which the present invention belongs. In addition, the terms should not be interpreted to have ideal or excessively formal meanings unless clearly defined in the present application.

Although the preferred embodiment of the present invention has been described above, it should be regarded that embodiments simply aggregating prior arts with the present invention or simply modifying the present invention, as well as the present invention, also fall within the scope of the present invention.

The invention claimed is:

1. A method of removing a liquid membrane using a high-speed particle beam, the method comprising:

a wet washing step of washing an object using a washing solution; and a dry washing step of simultaneously removing the washing solution remaining on the object and pollutants or foreign substances contained in the washing solution by injecting sublimation particles, wherein the dry washing step is characterized in that a particle generation gas passing through a nozzle including a first dilating portion and a second dilating portion is injected onto the object and an average dilation angle of the second dilating portion is wider than a dilation angle of the first dilating portion, and the dry washing step includes:

a nucleus generation step of generating nuclei as the particle generation gas rapidly expands while passing through an orifice provided in a nozzle throat of the nozzle;

a particle generation step of generating the sublimation particles as growth of nuclei is accomplished while the particle generation gas passes through the first dilating portion extended from an outlet of the nozzle throat, after performing the nucleus generation step; and a particle acceleration step of offsetting growth of a boundary layer and increasing speed of injecting the sublimation particles as the particle generation gas passes through the second dilating portion extended from an outlet of the first dilating portion and having the average dilation angle wider than the dilation angle of the first dilating portion, after performing the particle generation step.

2. The method according to claim 1, further comprising a drying step of drying the object, performed together with the dry washing step so that condensation of moisture may not occur on a surface of the object as the surface of the object is cooled down by the sublimation particles in the dry washing step.

3. The method according to claim 2, wherein the drying step includes a heating step of heating the object by providing a heating device under the object.

4. The method according to claim 2, wherein the drying step includes a nitrogen injection step of drying the surface of the object by injecting nitrogen on the object.

5. The method according to claim 1, wherein the dry washing step is performed inside a tightly sealed chamber, and the chamber is filled with carbon dioxide or nitrogen so that condensation of moisture may not occur on a surface of the object as the surface of the object is cooled down by the sublimation particles.

6. The method according to claim 1, further comprising:

a first transfer step of loading the object onto a dry washing position after performing the wet washing step; and a second transfer step of unloading the object from the dry washing position after performing the dry washing step.

7. The method according to claim 1, wherein the particle generation gas is formed of carbon dioxide, and the first dilating portion has a dilation angle of 0° and 30°, whereas the second dilating portion has an average dilation angle increased by 10° to 45° compared with the dilation angle of the first dilating portion.

8. The method according to claim 7, wherein the dry washing step further includes, after performing the particle acceleration step, a flow control step of forming a high-speed core of the sublimation particles outside the nozzle as the particle generation gas passes through the third dilating portion extended from an outlet of the second dilating portion and having a dilation angle increased by 10° to 45° compared with the average dilation angle of the second dilating portion and lower than 90° in maximum.

9. A method of removing a liquid membrane using a high-speed particle beam, the method comprising:

a dry washing step of removing the liquid membrane existing on an object and foreign substances or pollutants contained in the liquid membrane by injecting sublimation particles, wherein the dry washing step is characterized in that a particle generation gas passing through a nozzle including a first dilating portion and a second dilating portion is injected onto the object and an average dilation angle of the second dilating portion is wider than a dilation angle of the first dilating portion, and the dry washing step includes:

a nucleus generation step of generating nuclei as the particle generation gas rapidly expands while passing through an orifice provided in a nozzle throat of the nozzle;

a particle generation step of generating the sublimation particles as growth of nuclei is accomplished while the particle generation gas passes through the first dilating portion extended from an outlet of the nozzle throat after performing the nucleus generation step; and a particle acceleration step of offsetting growth of a boundary layer and increasing speed of injecting the sublimation particles as the particle generation gas passes through the second dilating portion extended from an outlet of the first dilating portion and having the average dilation angle wider than the dilation angle of the first dilating portion, after performing the particle generation step.

10. The method according to claim 9, further comprising a drying step of drying the object, performed together with the dry washing step so that condensation of moisture may not occur on a surface of the object as the surface of the object is cooled down by the sublimation particles, in the dry washing step.

11. The method according to claim 10, wherein the drying step includes a heating step of heating the object by providing a heating device under the object.

12. The method according to claim 10, wherein the drying step includes a nitrogen injection step of drying the surface of the object by injecting nitrogen on the object.

13. The method according to claim 9, wherein the dry washing step is performed inside a tightly sealed chamber, and the chamber is filled with carbon dioxide or nitrogen so that condensation of moisture may not occur on a surface of the object as the surface of the object is cooled down by the sublimation particles.

14. The method according to claim 9, further comprising: a first transfer step of loading the object onto a dry washing position as a prior step of the dry washing step.

15. The method according to claim 9, wherein in the dry washing step, the particle generation gas is formed of carbon dioxide, and the first dilating portion has a dilation angle of 0° and 30°, whereas the second dilating portion has an average dilation angle increased by 10° to 45° compared with the dilation angle of the first dilating portion.

16. The method according to claim 15, wherein the dry washing step further includes, after performing the particle acceleration step, a flow control step of forming a high-speed core of the sublimation particles outside the nozzle as the particle generation gas passes through the third dilating portion extended from an outlet of the second dilating portion and having a dilation angle increased by 10° to 45° compared with the average dilation angle of the second dilating portion and lower than 90° in maximum.

17. The method according to claim 3, wherein the drying step includes a nitrogen injection step of drying the surface of the object by injecting nitrogen on the object.

18. The method according to claim 11, wherein the drying step includes a nitrogen injection step of drying the surface of the object by injecting nitrogen on the object.

* * * * *